US009194262B2

(12) United States Patent
Rudolph

(10) Patent No.: US 9,194,262 B2
(45) Date of Patent: Nov. 24, 2015

(54) MULTI-VALVE ACTUATING VALVE BRIDGE

(71) Applicant: Caterpillar Inc., Peoria, IL (US)

(72) Inventor: Paul D. Rudolph, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/053,792

(22) Filed: Oct. 15, 2013

(65) Prior Publication Data

US 2015/0101555 A1 Apr. 16, 2015

(51) Int. Cl.
*F01L 1/26* (2006.01)

(52) U.S. Cl.
CPC ..... *F01L 1/26* (2013.01)

(58) Field of Classification Search
CPC ..... F01L 1/26
USPC ..... 123/90.22, 90.39
See application file for complete search history.

(56) References Cited

U.S. PATENT DOCUMENTS

| | | | | |
|---|---|---|---|---|
| 3,963,004 | A | 6/1976 | Lysinger et al. | |
| 4,327,677 | A | 5/1982 | Vander Bok | |
| 4,922,867 | A | 5/1990 | Matthews | |
| 5,699,762 | A * | 12/1997 | Horiuchi | 123/90.22 |
| 7,150,410 | B1 * | 12/2006 | Straub | 239/5 |

* cited by examiner

*Primary Examiner* — Ching Chang
(74) *Attorney, Agent, or Firm* — Miller, Matthias & Hull LLP

(57) ABSTRACT

A multi-valve actuating valve bridge for an engine is provided. The valve bridge includes a rocker arm engaging tappet head and at least two arms extending transversely of the rocker arm and engaging the tappet head. The valve bridge further includes a valve stem guide pocket provided on each of the arms. The valve stem guide pocket includes a valve stem contact face and a tapered surface extending from the valve stem contact face towards an opening of the valve stem guide pocket. The tapered surface defines an inverted frusto-conical cavity. A first inner diameter of the valve stem guide pocket at the valve stem contact face is greater than a second inner diameter of the valve stem guide pocket at the opening.

10 Claims, 8 Drawing Sheets

MULTI-VALVE ACTUATING VALVE BRIDGE

TECHNICAL FIELD

The present disclosure relates to a valve actuation assembly for an internal combustion engine, and more particularly to a multi-valve actuating valve bridge.

BACKGROUND

Simultaneous actuation of pairs of valves associated with a cylinder in an internal combustion engine is usually achieved by a valve bridge. The valve bridge is actuated by a rocker arm, to contact terminal ends of valve stems associated with the valves to cause the valves to operate between an open and a closed position. In situations of momentary valve sticking, momentary piston to valve contact, valve train separations from dynamic operation, or any other similar situation which may interfere in simultaneous movement of the valves, distribution of the load on the valve bridge may be unequal. This can lead to application of uneven forces and stresses on the valve bridge and the valves, which may result in unnecessary damage and breakage of the valve bridge and the valves.

U.S. Pat. No. 4,922,867 relates to a valve actuating mechanism for an internal combustion engine is provided including an integrally formed stop element to limit the axial travel of the valves toward the piston to a predetermined maximum extent in the event an adjacent associated valve becomes stuck and unmovable. The present invention further provides a valve actuating mechanism including a guideless valve bridge with specifically configured contact faces which prevents both the excess axial movement of the valve stem and the transfer of undesired loads to the valve stem or adjacent structures.

SUMMARY OF THE DISCLOSURE

In one aspect of the present disclosure, a multi-valve actuating valve bridge for an engine is provided. The valve bridge includes a rocker arm engaging tappet head and at least two arms extending transversely of the rocker arm and engaging the tappet head. The valve bridge further includes a valve stem guide pocket provided on each of the arms. The valve stem guide pocket includes a valve stem contact face and a tapered surface extending from the valve stem contact face towards an opening of the valve stem guide pocket. The tapered surface defines an inverted frusto-conical cavity. A first inner diameter of the valve stem guide pocket at the valve stem contact face is greater than a second inner diameter of the valve stem guide pocket at the opening.

In another aspect of the present disclosure, a multi-valve actuating valve bridge for an engine is provided. The valve bridge includes a rocker arm engaging tappet head and at least two arms extending transversely of the rocker arm and engaging the tappet head. The valve bridge further includes a valve stem guide pocket provided on each of the arms. The valve stem guide pocket includes a valve stem contact face. A first inner diameter of the valve stem guide pocket at the valve stem contact face is greater than a second inner diameter of the valve stem guide pocket at the opening.

In a yet another aspect, a valve actuation assembly for an engine is provided. The valve actuation assembly includes a rocker arm and a multi-valve actuating valve bridge. The valve bridge includes a rocker arm engaging tappet head and at least two arms extending transversely of the rocker arm and engaging the tappet head. The valve bridge further includes a valve stem guide pocket provided on each of the arms. The valve stem guide pocket includes a valve stem contact face and a tapered surface extending from the valve stem contact face towards an opening of the valve stem guide pocket. The tapered surface defines an inverted frusto-conical cavity. A first inner diameter of the valve stem guide pocket at the valve stem contact face is greater than a second inner diameter of the valve stem guide pocket at the opening.

Other features and aspects of this disclosure will be apparent from the following description and the accompanying drawings.

DETAILED DESCRIPTION

Figure 1:
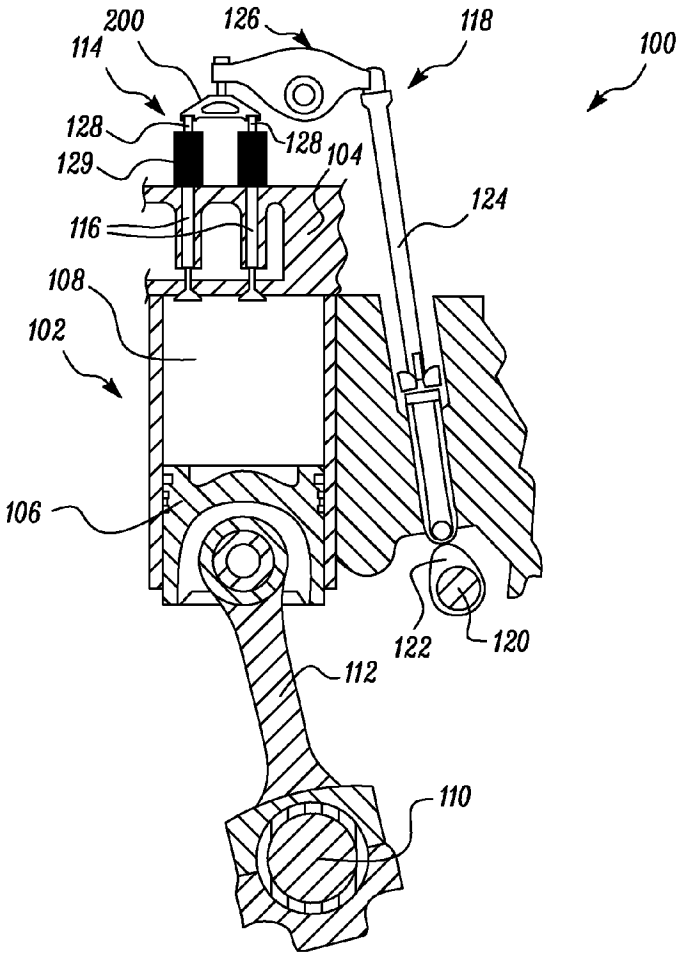
FIG. 1 illustrates an exemplary internal combustion engine.

The present disclosure relates to a multi-valve actuator valve bridge for an internal combustion engine. FIG. 1 illustrates an exemplary internal combustion engine 100, hereinafter referred to as the engine 100. The engine 100 may be any type of engine (internal combustion, gas, diesel, gaseous fuel, natural gas, or propane based engine etc.), may be of any size, with any number of cylinders, and in any configuration ("V," in-line, radial, etc.). The engine 100 may be used to power any machine or other device, including on-highway trucks or vehicles, off-highway trucks or machines, earth moving equipment, generators, aerospace applications, locomotive applications, marine applications, pumps, stationary equipment, and other engine powered applications.

In an aspect of the present disclosure, the engine 100 may be a compression ignition internal combustion engine, such as a diesel engine. For clarity, the following description refers to a single cylinder engine, but the principle of the present disclosure can as easily be applied to a multi-cylinder engine. The engine 100 includes a cylinder block 102, and a cylinder head 104 attached to the cylinder block 102. In the exemplary embodiment shown in FIG. 1, the engine 100 may include a piston 106 configured to reciprocate within a cylinder 108 defined in the cylinder block 102. The piston 106 is connected to a crankshaft 110 via a connecting rod 112. The engine 100 may include a valve train 114. The valve train 114 may include one or more valves 116 such as either one of fuel injection valves, intake valves and exhaust valves, disposed within the cylinder head 104. The valves 116 are operative between an open position and a closed position.

The valve train 114 further includes a valve actuation assembly 118. In an exemplary embodiment, the valve actuation assembly 118 includes a camshaft 120 having a lobe 122 to push against a push rod 124 and configured to transfer the rotary motion of the camshaft 120 into a linear motion of valves 116 via a rocker arm assembly 126 and a valve bridge 200. In the illustrated embodiment, the rocker arm assembly 126 is pivotally mounted on the cylinder head 104 about a pivot point and engages with the valve bridge 200. In an aspect of the present disclosure, the valve bridge 200 is a multi-valve actuating valve bridge. As will be appreciated by a person having ordinary skill in the art, the valve bridge 200 is shown to be associated with two valves 116, however, the valve bridge 200 may be associated with any number of valves without deviating from the scope of the present disclosure.

Furthermore, the valve bridge 200 may be connected to each of the valves 116 through a pair of valve stem 128. A valve spring 211 may be located around each valve stem 128 between the cylinder head 104 and the valve bridge 200. The valve spring 211 may be configured to bias the valves 116 into engagement with respective valve seats to close fuel intake and/or exhaust ports.

Figure 2:
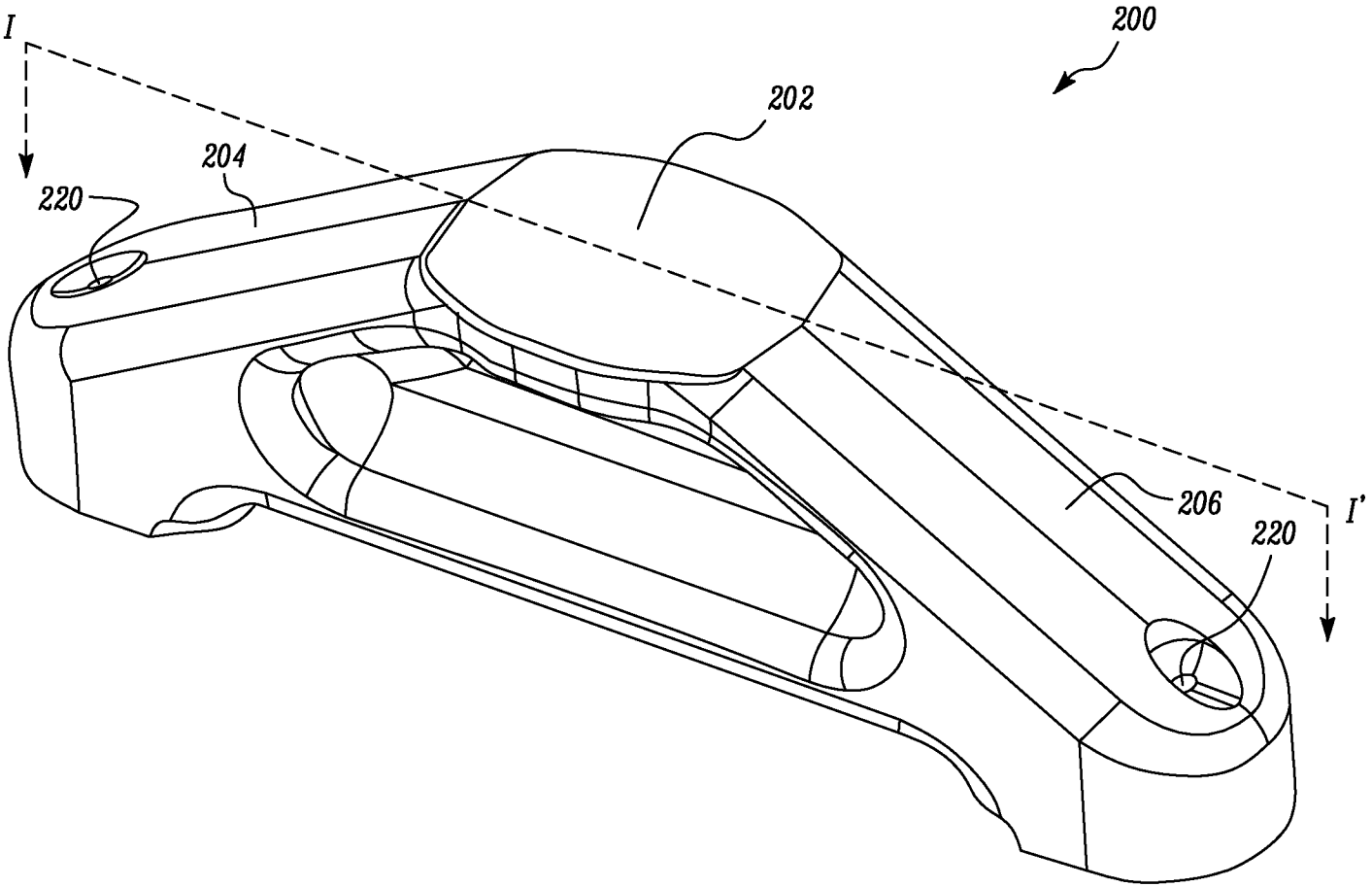
FIG. 2 illustrates a perspective view of a multi-valve actuating valve bridge, according to an aspect of the present disclosure.
Figure 3:
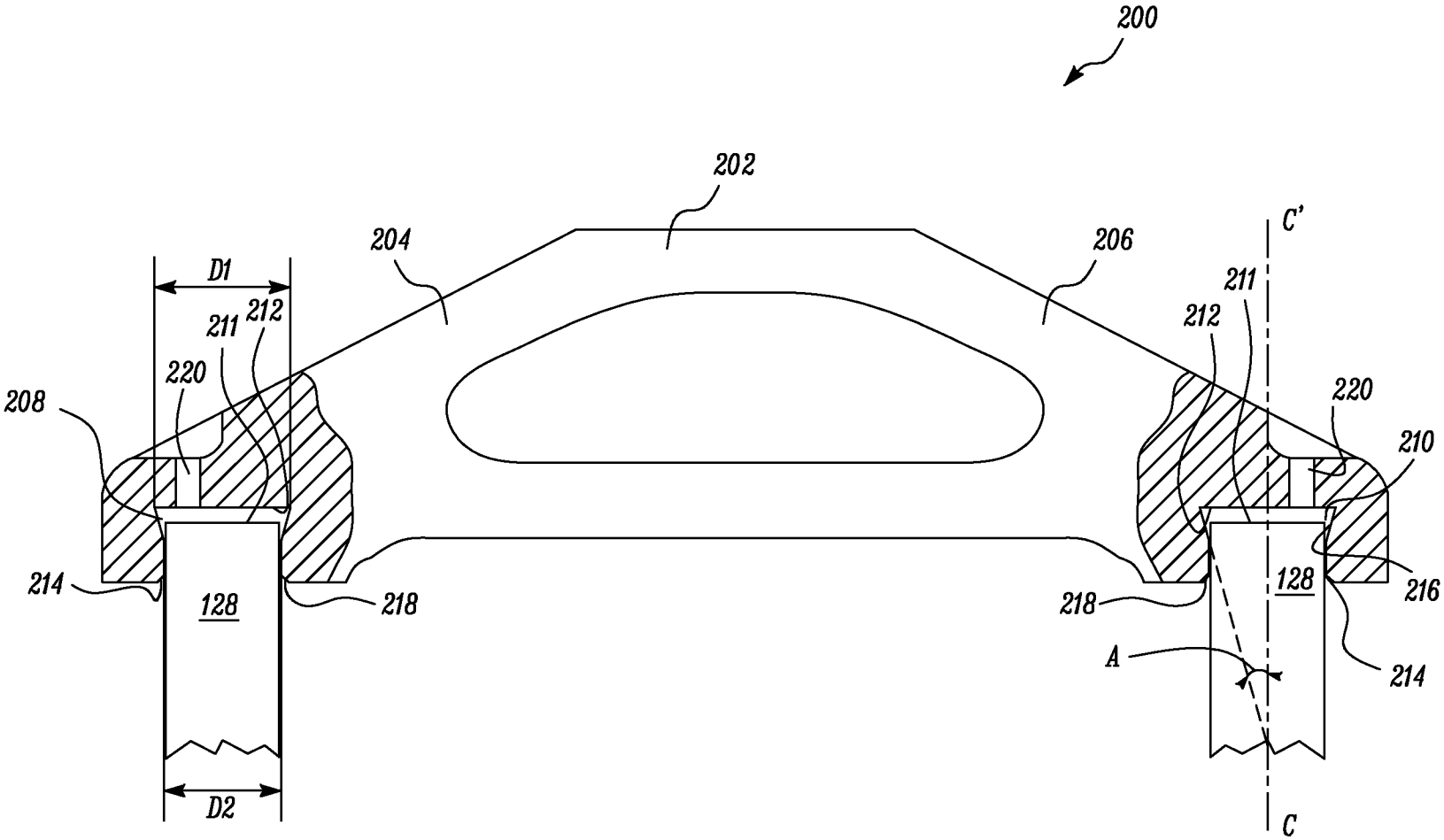
FIG. 3 illustrates a cross sectional view of the multi-valve actuating valve bridge of FIG. 2.

FIG. 2 illustrates an exemplary multi-valve actuating valve bridge 200 according to an aspect of the present disclosure. FIG. 3 illustrates a sectional view of the valve bridge 200 taken along an axis I-I, of FIG. 2. In an aspect of the present disclosure, the valve bridge 200 may be a floating type valve bridge, which is unrestrained and floats thereby causing its reorientation in response to uneven valve opening displacement, if any uneven displacement of the valves 116 occurs. In an alternate aspect of the present disclosure, the valve bridge 200 may be a guided type of valve bridge, which remains fixed and/or restrained at both the sides.

The valve bridge 200 includes a central upstanding rocker arm engaging tappet head 202, hereinafter referred to as the tappet head 202 and two arms 204, 206 spaced from and extending transversely from and engaging the tappet head 202. The rocker arm assembly 126 may include a tappet contact surface (not shown) configured to engage with the tappet head 202 of the valve bridge 200 to push the valves 116 in either open and/or closed position simultaneously.

In an embodiment of the present disclosure, the valve bridge 200 may include valve stem guide pockets 208, 210 provided on each of the arms 204, 206 respectively. The valve stem guide pockets 208, 210 may be configured to engage the respective valve stems 132. An upper surface 211 of the valve stems 128 may be contoured appropriately to engage within the valve stem guide pockets 208, 210 respectively. As may be understood by a person having ordinary skill in the art, the contour may be selected such that the valve stems 128 may maintain a strong positive contact with the valve stem guide pockets 208, 210 and therefore the valve bridge 200 during the operation of the engine 100. In an embodiment of the present disclosure, the valve stem guide pockets 208, 210 may be made up of mild steel and manufactured by milling process. Alternatively, the valve stem guide pockets 208, 210 may be manufactured by casting process.

Each of the valve stem guide pockets 208, 210 may include a valve stem contact face 212 configured to engage the upper surface 211 of the respective valve stems 128. Furthermore, the valve stem guide pockets 208, 210 may form a cavity having an opening 214 at one end and the valve stem contact face 212 on an opposite end. In an aspect of the present disclosure, the cavity of the valve stem guide pocket 208, 210 may be an inverted frusto-conical cavity (as shown in FIG. 3). For example, a first inner diameter D1 of the valve stem guide pockets 208, 210 at the valve stem contact face 212 is greater than a second inner diameter D2 of the valve stem guide pockets 208, 210 at the opening 214 end. In an exemplary embodiment of the present disclosure, the second inner diameter D2 of the valve stem guide pockets 208, 210 at the opening 214 end may be in a range of about 1 mm to 10 mm. In an exemplary embodiment, a ratio of the first inner diameter D1 and the second inner diameter D2 of the valve stem guide pockets 208, 210 may be in a range of about 2:1.95 to 2:1.5. Further, a difference between the first inner diameter D1 and the second inner diameter D2 of the valve stem guide pocket 208, 210 is in a range of about 1 mm to 15 mm Furthermore, the valve stem guide pockets 208, 210 include a tapered surface 216 extending from the valve stem contact face 212 towards the opening 214. In an exemplary embodiment of the present disclosure, the tapered surface 216 of the valve stem guide pockets 208, 210 is at an angle A with respect to a central axis C-C' of the valve stem guide pockets 208, 210. For example, the angle A may be within a range of about 2 degrees to 15 degrees. In an aspect of the present disclosure, the tapered surface 216 includes a chamfered edge 218 at the opening 214 of the valve stem guide pocket 208, 210

As shown in FIGS. 2 and 3, in an aspect of the present disclosure, the valve bridge 200 may include a lubrication through bore 220 provided at the valve stem contact face 212 of each of the valve stem guide pockets 208, 210. The lubrication through bore 220 may be configured to receive lubrication oil from a lubricant flinger and distribute it to the cavity of the valve stem guide pockets 208, 210.

Figure 4:
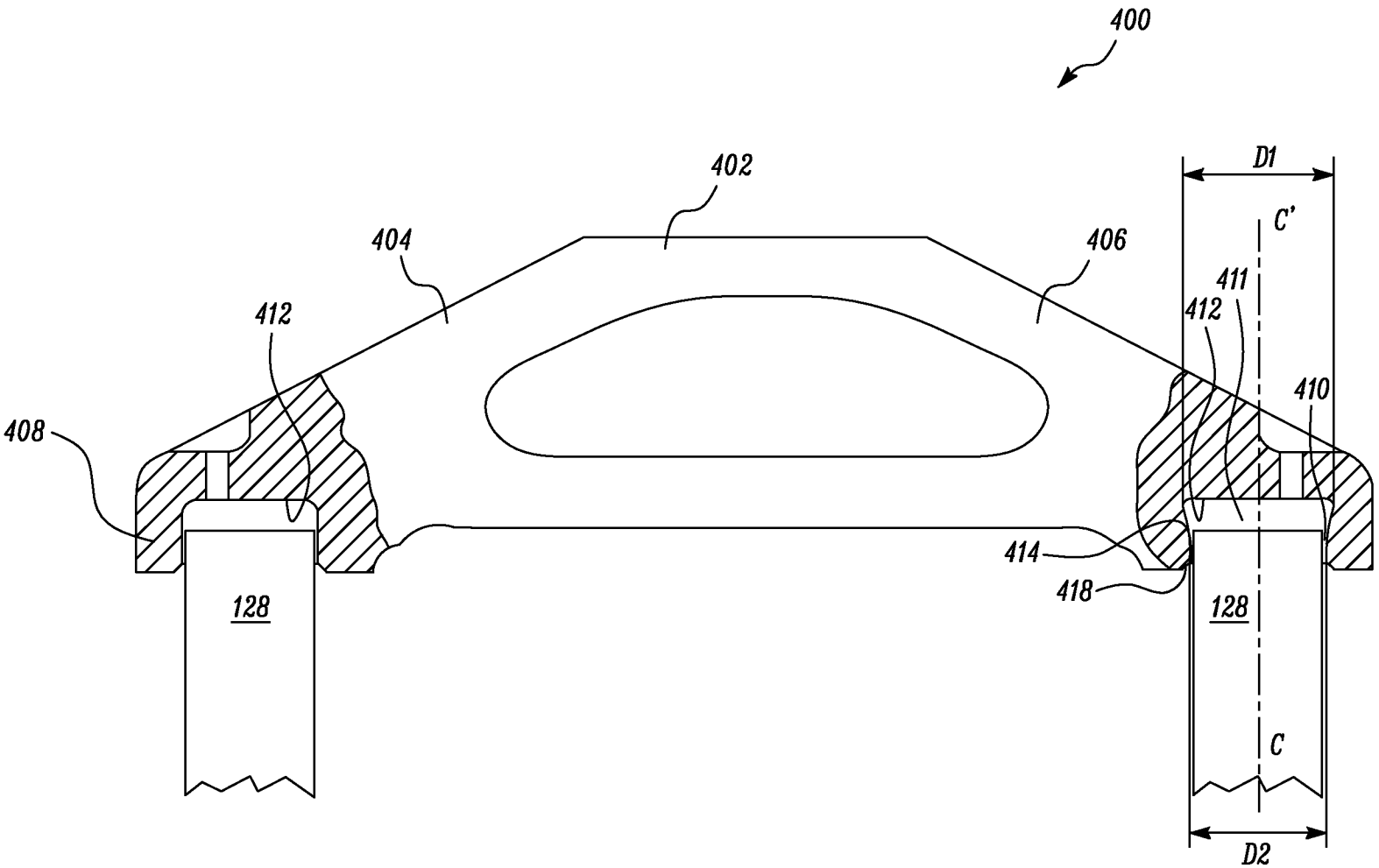
FIG. 4 illustrates a cross sectional view of the multi-valve actuating valve bridge, according to an alternate embodiment of the present disclosure.

FIG. 4 illustrates a sectional view of a valve bridge 400 according to an alternate embodiment of the present disclosure. The valve bridge 400 may include a rocker arm engaging tappet head 402 and a pair of arms 404, 406 extending laterally from the tappet head 402. In an embodiment of the present disclosure, the valve bridge 400 may include valve stem guide pockets 408, 410 provided on each of the arms 404, 406 respectively. In an exemplary embodiment, one of the valve stem guide pockets, such as the pocket 410 may include an inverted frusto-conical cavity, whereas the second pocket 408 may have a rectangular or circular cross section having the same first inner diameter D1 at a valve stem contact face 412 and the second inner diameter D2 at an opening 414 of the pocket 208. Furthermore, as shown in FIG. 4, the valve stem guide pockets 408, 410 may include a chamfered edge 418 at the opening 414.

Figure 5:
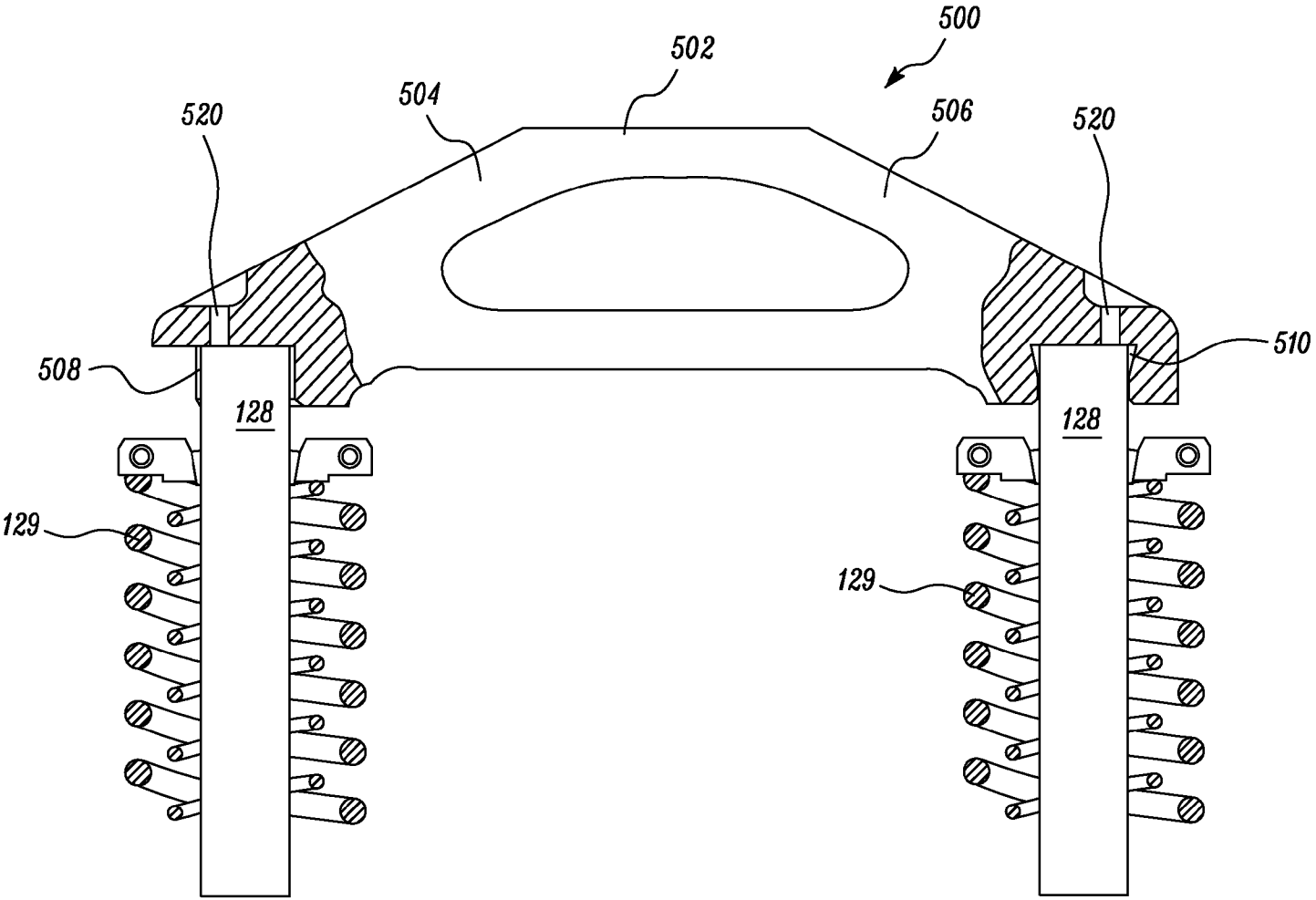
FIG. 5 illustrates a schematic view of the multi-valve actuating valve bridge in a straight position.

FIG. 5 illustrates a sectional view of a valve bridge 500 according to a yet another embodiment of the present disclosure. The valve bridge 500 may include a rocker arm engaging tappet head 502 and a pair of arms 504, 506 extending laterally from the tappet head 502. In an embodiment of the present disclosure, the valve bridge 500 may include valve stem guide pockets 508, 510 provided on each of the arms 504, 506 respectively. In an exemplary embodiment, one of the valve stem guide pockets, such as the pocket 510 may include an inverted frusto-conical cavity, whereas the second pocket 508 may have a rectangular or circular cross section. Furthermore, as shown in FIG. 5, the valve stem guide pockets 508 may be completely milled out to the end of the bridge 500, such that there is no material between the valve pocket 508 and that side of the bridge 500.

Industrial Applicability

The industrial applicability of the multi-valve actuating valve bridge 200, 400 of the valve actuation assembly 118 for the engine 100, described herein will be readily appreciated from the foregoing discussion.

Simultaneous actuation of pairs of valves associated with a cylinder in an internal combustion engine is usually achieved by a valve bridge. The valve bridge is actuated by a rocker arm, to contact terminal ends of valve stems associated with the valves to cause the valves to reciprocate between open and closed positions. In situations of momentary valve sticking, momentary piston to valve contact, valve train separations from dynamic operation, or any other similar situation which may interfere in simultaneous movement of the valves, distribution of the load on the valve bridge may be unequal. This can lead to application of uneven forces and stresses on the valve bridge and the valves, which may result in unnecessary damage and breakage of the valve bridge and the valves.

The valve actuation assembly 118 having the valve bridge 200, 400 with the valve stem guide pockets 208, 210, 410, 510 according to the aspects of the present disclosure, functions effectively to allow tilting of the valve bridge 200, 400, 500 about the valve stems 128 in situations of unequal distribution of the load on the valve bridge 200. Further, the valve stems 128 are in tight contact with the valve stem guide pockets 208, 210, 410, 510 which prevents the bridge from slipping out of the respective pockets 208, 210, 410, 510. Therefore, causing minimal or no damage to the valves 116, the valve bridge 200, 400, 500, the interface of the valve stems 128 with the respective guide pockets 208, 210, 410, 510 and the engine 100.

Figure 6:
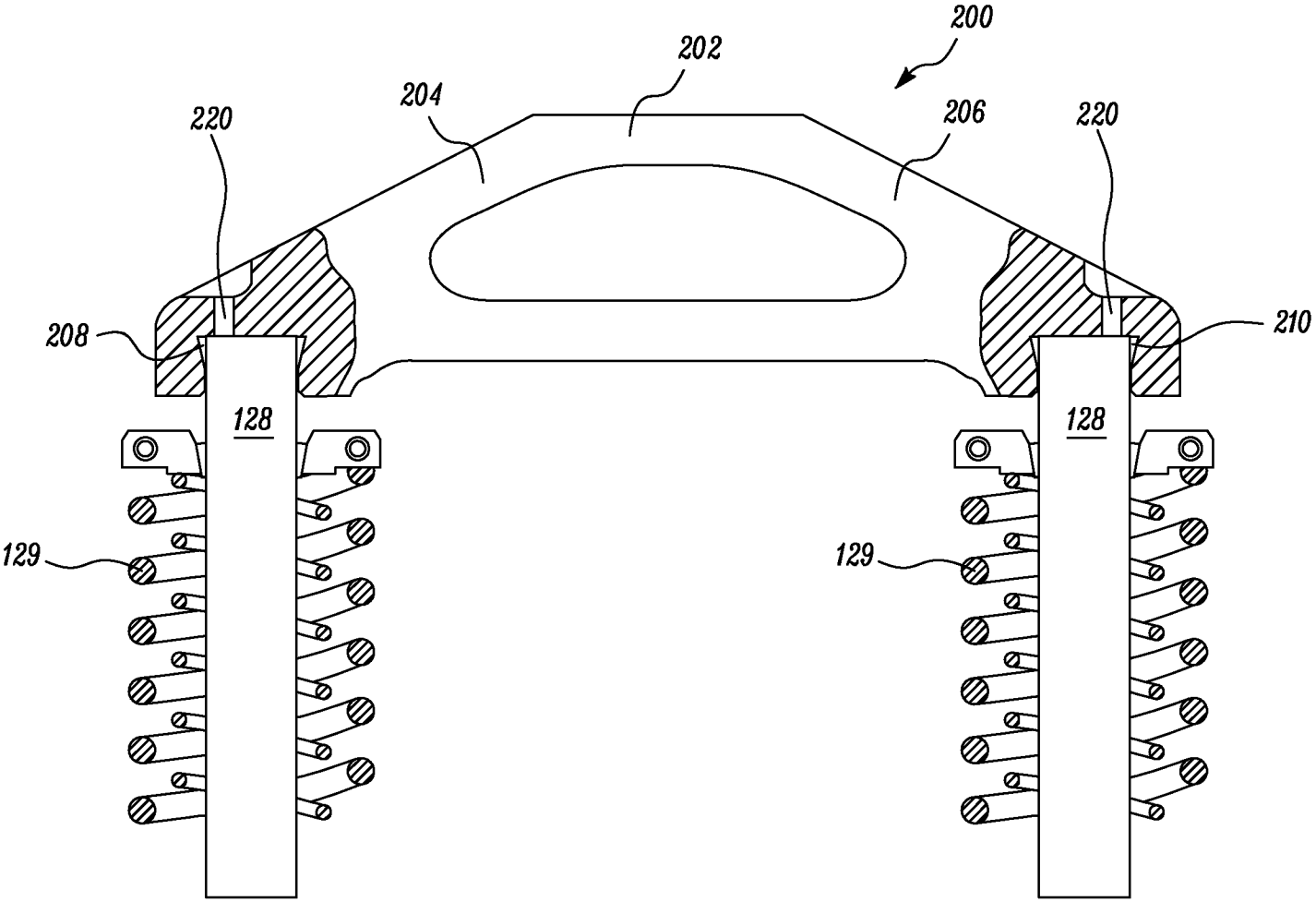
FIG. 6 illustrates a schematic view of the multi-valve actuating valve bridge in a first tilted position.
Figure 7:
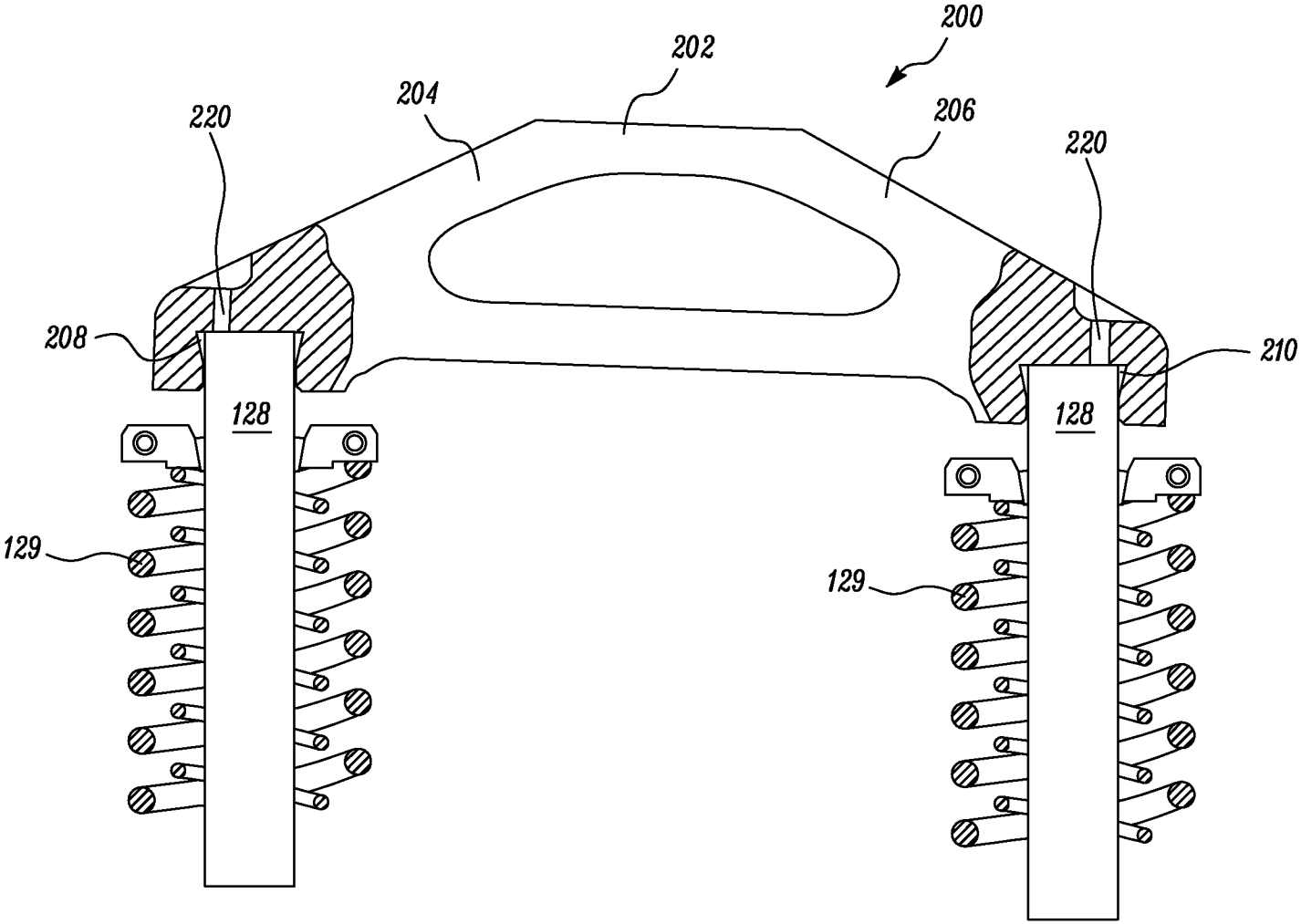
FIG. 7 illustrates a schematic view of the multi-valve actuating valve bridge in a second tilted position.
Figure 8:
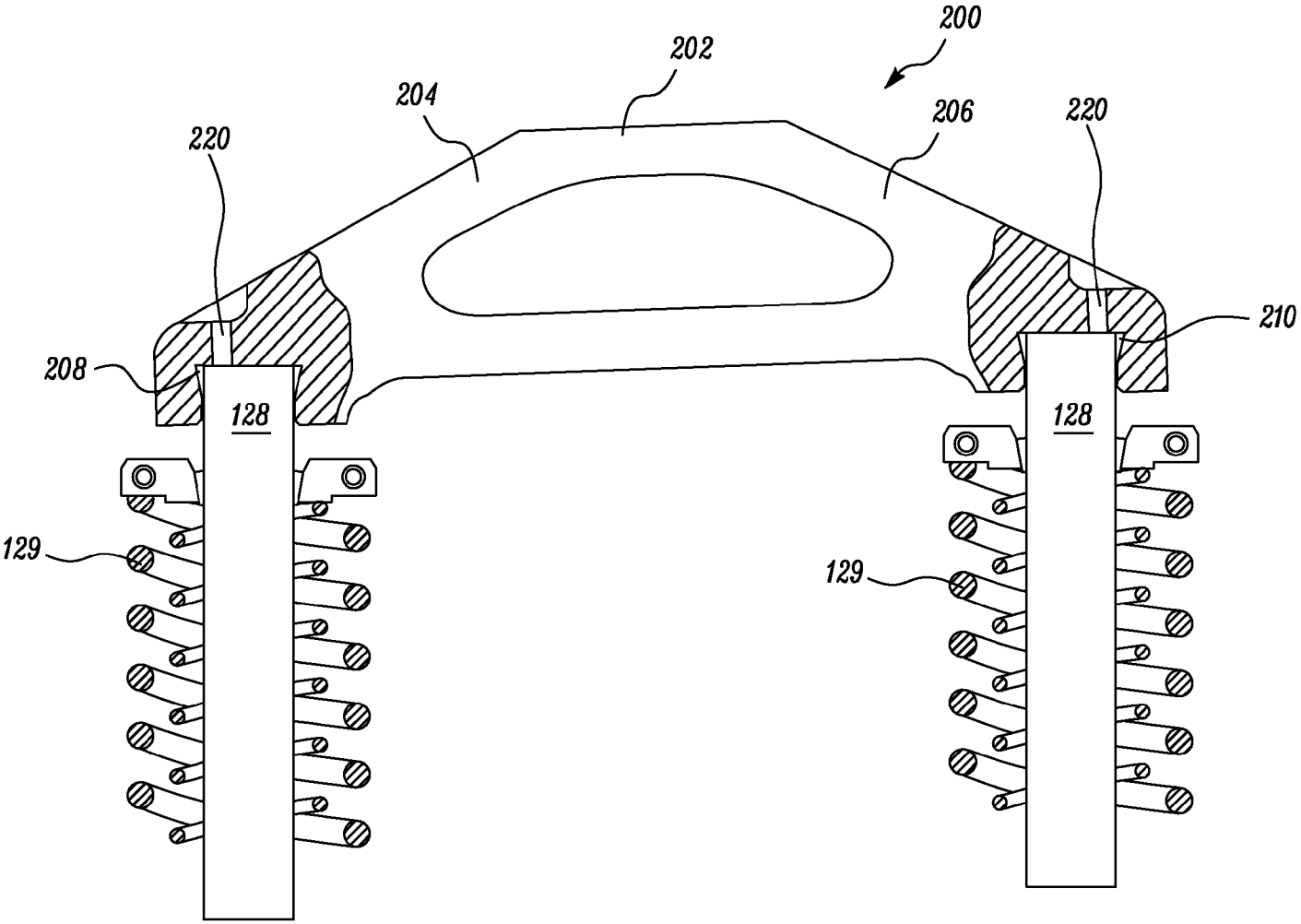
FIG. 8 illustrates a schematic view of the multi-valve actuating valve bridge in another tilted position.

FIG. 6 illustrates a perspective view of the valve stems 128 and the valve bridge 200 during normal engine operations. In this case, the valves 116 are operated simultaneously in the open and the closed positions. Further, as shown in FIGS. 7 and 8, the valve bridge 200 may tilt to either on the left hand side or on the right hand side, as desired, in situations of uneven operation of the valves 116 and/or unequal distribution of load on the valve bridge 200. Additionally, the inverted frusto-conical cavity of the valve stem guide pockets 208, 210 allow the valves 116 to function at different heights above the cylinder head 104 without failure.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A multi-valve actuating valve bridge for an engine comprising:

a rocker arm engaging tappet head;

at least two arms extending transversely of the rocker arm and engaging the tappet head; and a valve stem guide pocket provided on each of the arms, at least one of the valve stem guide pocket including:

a valve stem contact face;

a tapered surface extending from the valve stem contact face towards an opening of the valve stem guide pocket, the tapered surface defining an inverted frusto-conical cavity; and a first inner diameter of the valve stem guide pocket at the valve stem contact face greater than a second inner diameter of the valve stem guide pocket at the opening.

2. The multi-valve actuating valve bridge of claim 1, wherein a ratio of the first inner diameter to the second inner diameter is in a range of 2:1.95 to 2:1.5.

3. The multi-valve actuating valve bridge of claim 1, wherein the tapered surface is at an angle of about 2 degrees to 15 degrees with respect to a central axis of the valve stem guide pocket.

4. The multi-valve actuating valve bridge of claim 1, wherein the tapered surface includes a chamfered edge at the opening of the valve stem guide pocket.

5. The multi-valve actuating valve bridge of claim 1 further comprising a lubrication through bore provided at the valve stem contact face.

6. The multi-valve actuating valve bridge of claim 1 is floating type valve bridge.

7. The multi-valve actuating valve bridge of claim 1 is made of mild steel.

8. The multi-valve actuating valve bridge of claim 1, wherein the valve stem guide pocket is manufactured by milling process.

9. The multi-valve actuating valve bridge of claim 1, wherein the valve stem guide pocket is manufactured by casting process.

10. A valve actuation assembly for an engine comprising:

a rocker arm; and a multi-valve actuating valve bridge including:

a rocker arm engaging tappet head;

at least two arms extending transversely of the rocker arm engaging tappet head; and a valve stem guide pocket provided on each of the arms, at least one of the valve stem guide pocket including:

a valve stem contact face;

a tapered surface extending from the valve stem contact face towards an opening of the valve stem guide pocket, the tapered surface defining an inverted frusto-conical cavity; and a first inner diameter of the valve stem guide pocket at the valve stem contact face greater than a second inner diameter of the valve stem guide pocket at the opening.

* * * * *